US010555553B2

(12) United States Patent
Binassi et al.

(10) Patent No.: US 10,555,553 B2
(45) Date of Patent: Feb. 11, 2020

(54) FILTER WITH IMPROVED HARDNESS AND FILTRATION EFFICIENCY

(71) Applicant: PHILIP MORRIS PRODUCTS S.A., Neuchatel (CH)

(72) Inventors: Enrico Binassi, Lausanne (CH); Yves Jordil, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 336 days.

(21) Appl. No.: 15/113,477

(22) PCT Filed: Dec. 23, 2014

(86) PCT No.: PCT/EP2014/079158
§ 371 (c)(1),
(2) Date: Jul. 22, 2016

(87) PCT Pub. No.: WO2015/124242
PCT Pub. Date: Aug. 27, 2015

(65) Prior Publication Data

US 2017/0049147 A1 Feb. 23, 2017

(30) Foreign Application Priority Data

Feb. 24, 2014 (EP) ..... 14156433

(51) Int. Cl.

| | |
|---|---|
| ***A24D 3/00*** | (2006.01) |
| ***A24D 3/08*** | (2006.01) |
| ***A24D 3/06*** | (2006.01) |
| ***A24D 3/14*** | (2006.01) |

(52) U.S. Cl.
CPC ..... *A24D 3/08* (2013.01); *A24D 3/068* (2013.01); *A24D 3/14* (2013.01)

(58) Field of Classification Search
None
See application file for complete search history.

(56) References Cited

U.S. PATENT DOCUMENTS

| | | | | |
|---|---|---|---|---|
| 7,934,510 | B2 * | 5/2011 | Gedevanishvili ..... | A24B 15/28 131/334 |
| 2013/0180536 | A1 | 7/2013 | Sebastian | |

FOREIGN PATENT DOCUMENTS

| | | |
|---|---|---|
| CN | 1817253 | 8/2006 |
| CN | 103088458 | 5/2013 |
| EP | 0 634 113 | 1/1995 |

(Continued)

OTHER PUBLICATIONS

PCT Search Report and Written Opinion for PCT/EP2014/079158 dated Apr. 17, 2015 (8 pages).

(Continued)

*Primary Examiner* — Linda L Gray
(74) *Attorney, Agent, or Firm* — Meuting, Raasch & Gebhardt, P.A.

(57) ABSTRACT

There is provided a smoking article comprising an aerosol generating substrate and a mouthpiece attached to the aerosol generating substrate. The mouthpiece includes a segment comprising a filtration material comprising polylactic acid, and an additive for reducing phenols. The mouthpiece further comprises one or more wrappers circumscribing the segment, the one or more wrappers have a combined basis weight of at least about 50 grams per square metre ($gm^{-2}$).

16 Claims, 5 Drawing Sheets

(56) References Cited

FOREIGN PATENT DOCUMENTS

| | | |
|---|---|---|
| EP | 2856891 | 4/2015 |
| WO | WO 2005/039330 | 5/2005 |
| WO | WO 2011/062628 | 5/2011 |
| WO | WO 2011/063632 | 6/2011 |
| WO | WO 2012/123702 | 9/2012 |
| WO | WO 2012/175979 | 12/2012 |
| WO | WO 2013/009410 | 1/2013 |
| WO | WO 2013/019616 | 2/2013 |
| WO | WO 2013/164623 | 11/2013 |
| WO | WO 2013/164624 | 11/2013 |
| WO | 2013/182995 | 12/2013 |
| WO | WO 2013/179009 | 12/2013 |
| WO | WO 2013/179524 | 12/2013 |

OTHER PUBLICATIONS

European Extended Search Report for Application No. 14156433.6 dated Apr. 3, 2014 (6 pages).
Office Action issued in Japan for Application No. 2016-552339 dated Nov. 14, 2018 (5 pages). English translation included.
Office Action issued in China for Application No. 201480074628.4 dated Mar. 5, 2019 (19 pages). English translation included.
Office Action issued in China for Application No. 201480074628.4 dated Aug. 19, 2019 (19 pages). English translation included.
Office Action issued in Japan for Application No. 2016/552339 dated Oct. 3, 2019 (4 pages). English translation included.

* cited by examiner

FILTER WITH IMPROVED HARDNESS AND FILTRATION EFFICIENCY

This application is a U.S. National Stage Application of International Application No. PCT/EP2014/079158, filed Dec. 23, 2014, which was published in English on Aug. 27, 2015, as International Patent Publication WO 2015/124242 A1. International Application No. PCT/EP2014/079158 claims priority to European Application No. 14156433.6 filed Feb. 24, 2014.

The present invention relates to a mouthpiece for a smoking article, comprising polylactic acid, and to a smoking article incorporating such a mouthpiece.

Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

After a smoking article has been smoked and the remainder of the article has been discarded, it is often desirable for the remainder of the article to degrade as quickly as possible. It has therefore been proposed to form portions of a smoking article, such as filters, from materials than are more degradable than those materials conventionally used for such portions. For example, it has been proposed to wholly or partially replace the cellulose acetate in a filter with polylactic acid, as polylactic acid tends to be more degradable than cellulose acetate.

However, cellulose acetate can directly or indirectly provide certain desirable properties for a filter, which are not as readily obtainable when the cellulose acetate of a filter is replaced with polylactic acid. For example, in conventional smoking articles, cellulose acetate fibres are typically sprayed with a triacetin additive. This can have two main effects on the filter. Firstly, the triacetin can bond adjacent fibres to provide a desired firmness for the filter. Secondly, the triacetin can improve the filtration of smoke constituents, such as phenols, from the smoke drawn through the filter. There is no known additive, which can perform both these functions when sprayed on polylactic acid fibres. At least two separate additives are therefore needed for a polylactic acid based filter, in order for it to replicate these desirable features of a cellulose acetate based filter. This can add complexity to the manufacturing process and may also require modification of existing machinery.

Therefore, despite the perceived degradation benefits for filters containing polylactic acid, there is currently not a commercially acceptable solution for using polylactic acid as a filtration material in a mouthpiece for a smoking.

According to a first aspect of the present invention, there is provided a smoking article comprising an aerosol generating substrate and a mouthpiece attached to the aerosol generating substrate. The mouthpiece includes a segment comprising a filtration material comprising polylactic acid, and an additive for reducing phenols. The mouthpiece further comprises one or more wrappers circumscribing the segment, the one or more wrappers have a combined basis weight of at least about 50 grams per square metre ($gm^{-2}$).

According to a second aspect of the present invention, there is provided a mouthpiece for a smoking article. The mouthpiece includes a segment comprising a filtration material comprising polylactic acid, and an additive for reducing phenols. The mouthpiece further comprises one or more wrappers circumscribing the segment, the one or more wrappers have a combined basis weight of at least about 50 grams per square metre ($gm^{-2}$).

By circumscribing the segment with one or more wrappers have a combined basis weight of at least about 50 grams per square metre ($gm^{-2}$), a desired firmness for the mouthpiece may be achieved. This firmness may be comparable to the firmness that would otherwise have been provided by the combination of cellulose acetate and triacetin in a conventional smoking article mouthpiece. The wrappers may be manufactured and provided around the segment in accordance with standard techniques.

Furthermore, since the one or more wrappers may enable the mouthpiece to have a desired firmness, there is no need for a second additive to be included in the mouthpiece in order to plasticize the filtration material. This means that the segment can be manufactured without modifying existing techniques or machinery. For example, if an additional additive was needed in order to provide firmness to the filtration material, a second spraying station could be needed for the filter manufacturing apparatus. This may require modification to existing machinery and may also require additional cleaning of parts of the machinery, such as the garniture tongue, resulting in undesirable downtime.

The inclusion of an additive for reducing phenols in the segment can help to reduce phenol levels delivered by the smoking article. This additive may be incorporated into the segment using a spraying station, which is typically used on existing machinery for incorporating a conventional additive, such as triacetin, into a conventional filter segment, such as one formed of cellulose acetate fibres.

Therefore, the present invention provides for a mouthpiece that incorporates polylactic acid as a filtration material, without sacrificing the firmness or phenol reducing capabilities that are typically associated with a conventional smoking article, and without needing to alter the machinery or processes that are typically used to manufacture such smoking articles.

The segment includes a filtration material comprising polylactic acid. The filtration material may have any suitable structure. For example, the filtration material may comprise a gathered sheet of material comprising polylactic acid. However, preferably the filtration material comprises a plurality of fibres formed at least in part from polylactic acid. Fibres are a particularly effective form of filtration material as they can provide tortuous passageways through which smoke can pass. Furthermore, when a smoking article is discarded after use, the fibres may degrade and disperse more readily than other structures, thus helping to improve the degradation properties of the mouthpiece or smoking article.

Preferably, the fibres are substantially unconnected to one another. That is, preferably no additive is included in the segment for binding the fibres together. This can help to improve the rate at which the fibres can degrade and disperse when a smoking article is discarded after use.

Preferably, the filtration material is a blend comprising polylactic acid and at least one other polymer. The additional polymer or polymers may provide additional properties to the filtration material. For example, the additional polymers can provide the filtration material with additional tensile strength and elasticity properties. Where the filtration material comprises a plurality of fibres made of a blend of different polymers, this can enable the fibres to be processed on the same machinery that is typically used for manufacture of cellulose acetate filters, at a speed typically associated with the manufacture of cellulose acetate filters, and with a comparable waste percentage and operational efficiency.

Therefore, preferably, the filtration material is a blend comprising polylactic acid blended with at least one of polyglicolic acid and poly-(L)-lactic acid. More preferably, the filtration material is a blend comprising polylactic acid, polyglicolic acid and poly-(L)-lactic acid. Such blends can result in a filtration material with desirable tensile strength and elasticity properties.

Preferably the filtration material comprises at least about 70% polylactic acid by weight, more preferably at least about 80% polylactic acid by weight, and even more preferably about 85% polylactic acid by weight.

Preferably the filtration material comprises less than about 20% polyglicolic acid by weight, more preferably less than about 15% polyglicolic acid by weight, and even more preferably about 10% polyglicolic acid by weight.

Preferably the filtration material comprises less than about 15% poly-(L)-lactic acid by weight, more preferably less than about 10% poly-(L)-lactic acid by weight, and even more preferably about 5% poly-(L)-lactic acid by weight.

In preferred embodiments the filtration material comprises a blend comprising about 85% by weight polylactic acid, about 10% by weight polyglicolic acid, and about 5% by weight poly-(L)-lactic acid.

As noted above, the segment comprising polylactic acid, also includes an additive for reducing phenols. That is, the segment includes an additive which is capable of capturing or otherwise converting at least some of the phenols produced by the smoking article.

Preferably, the additive does not bond elements of the filtration material together.

Preferably, the additive comprises at least one of triacetin, triethyl citrate (TEC), polyethylene glycol, a mixture of triacetin with cellulose acetate flakes, or any combination thereof.

One particularly preferred additive is an additive comprising a mixture of at least about 90% triacetin and less than about 10% cellulose acetate flakes, more preferably between about 96% and about 98% triacetin and between about 2% and about 4% cellulose acetate flakes. Such additives can be particularly desirable, as they can replicate the synergy between triacetin and cellulose acetate fibres in a standard cellulose acetate filter.

Another preferred additive is low-molecular-weight glycols, such as polyethylene or polyprophylene based glycols having a molecular weight between about 100 and about 1000, more preferably between about 200 and about 800, even more preferably between about 300 and about 500. In one preferred embodiment, the additive is polyethylene glycol 400 (PEG 400).

Another preferred additive is triethyl citrate. As can be seen from Table 2 below, such an additive can be particularly effective at reducing phenols.

Preferably, the additive is a transparent liquid with no odor or taste. Preferably, the additive has a viscosity that is the same as or greater than the viscosity of triacetin. This can allow the additive to be added to the filtration material using the techniques and equipment normally used for applying triacetin to standard cellulose acetate filters.

Preferably, the additive is provided in an amount of at least about 0.1 percent by weight of the filtration material, more preferably at least about 5 percent by weight of the filtration material. Alternatively or additionally, the additive is preferably provided in an amount of less than about 15 percent by weight of the filtration material, more preferably less than about 12 percent by weight of the filtration material, even more preferably less than about 7 percent by weight of the filtration material.

Preferably the additive for reducing phenols is the only additive included in the segment. This can allow the segment to be manufactured without modifying existing segment making machinery.

The additive may be incorporated into the segment in any suitable manner. However, preferably the additive is incorporated into the segment by spraying the additive onto the filtration material when the segment is being formed. For example, the filtration material may be a continuous band of fibres, which are bundled together to form the segment, and the additive may be sprayed onto these fibres.

The one or more wrappers circumscribing the segment have a basis weight greater than about 50 grams per square metre ($gm^{-2}$). It has been found that this provides a desired firmness for the mouthpiece. Preferably, the one or more wrappers have a basis weight less than about 100 $gm^{-2}$. It has been noted that such a value can provide a good balance between firmness and still allowing the one or more wrappers to be relatively straightforward to handle during manufacture.

More preferably, the one or more wrappers have a basis weight between about 65 $gm^{-2}$ and about 85 $gm^{-2}$. Even more preferably, the one or more wrappers have a basis weight between about 70 $gm^{-2}$ and about 80 $gm^{-2}$. In preferred embodiments, a single wrapper is provided and this single wrapper has a basis weight as set out above. Alternatively, in some embodiments, multiple wrappers may be provided, and the combined basis weight of the multiple wrappers may be the basis weight as set out above. Preferably, the one or more wrappers comprise a first wrapper having a basis weight as set out above, the first wrapper being in direct abutment with the filtration material.

Preferably, the one or more wrappers have a bending stiffness of at least about 0.08 N in the machine direction of the wrapper. The one or more wrappers may have a bending stiffness less than about 0.2 N in the machine direction of the wrapper. The machine direction of the wrappers preferably corresponds to the transverse direction of the smoking article.

Preferably, the one or more wrappers have a bending stiffness of at least about 0.04 N in the cross direction of the wrapper. The one or more wrappers may have a bending stiffness less than about 0.1 N in the cross direction of the wrapper. The cross direction of the wrapper preferably corresponds to the longitudinal direction of the smoking article.

The term "bending stiffness" used in this specification refers to the resistance of the material to a bending force applied perpendicular to the plain of the material. The bending stiffness may be determined by International Organization for Standardization (ISO) test ISO 5628: 2012.

If more than one wrapper is provided, the total bending stiffness in a given direction of the one or more wrappers is the combined bending stiffness of the wrappers.

The desired firmness properties that the one or more wrappers help the mouthpiece to have may be quantified in terms of a hardness value. The term "hardness" used throughout this specification denotes the resistance to deform. Hardness is generally expressed as a percentage. FIG. 1 shows a cigarette 101 before applying a load F and the same cigarette 103 whilst applying load F. The cigarette 101 before load F has been applied has a diameter $D_S$. The cigarette 103 after applying a set load for a set duration (but with the load still applied) has a (reduced) diameter $D_d$. The depression is $d=D_S-D_d$. Referring to FIG. 1, hardness is given by:

$$\text{hardness}(\%) = \frac{D_d}{D_S} * 100\%$$

where $D_S$ is the original (undepressed) cigarette diameter, and $D_d$ is the depressed diameter after applying a set load for a set duration. The harder the material, the closer the hardness is to 100%.

As is described in more detail below, and generally known in the art, to determine the hardness of a portion (such as a filter) of a smoking article, smoking articles should be aligned parallel in a plane and the same portion of each smoking article to be tested should be subjected to a set load for a set duration. This test is performed using a known DD60A Densimeter device (manufactured and made commercially available by Heinr. Borgwaldt GmbH, Germany), which is fitted with a measuring head for cigarettes and with a cigarette receptacle.

The load is applied using two load applying cylindrical rods, which extend across the diameter of all of the smoking articles at once. According to the standard test method for this instrument, the test should be performed such that twenty contact points occur between the smoking articles and the load applying cylindrical rods. If the hardness of a filter or filter portion is being tested then, in some cases, the filters to be tested may be long enough such that only ten smoking articles are needed to form twenty contact points, with each smoking article contacting both load applying rods (because they are long enough to extend between the rods). In other cases, if the filters are too short to achieve this, then twenty smoking articles should be used to form the twenty contact points, with each smoking article contacting only one of the load applying rods, as further discussed below.

Two further stationary cylindrical rods are located underneath the smoking articles, to support the smoking articles and counteract the load applied by each of the load applying cylindrical rods. Such an arrangement is described in more detail below, and shown in FIGS. 5 to 7.

For the standard operating procedure for such an apparatus, an overall load of 2 kg is applied for a duration of 20 seconds. After 20 seconds have elapsed (and with the load still being applied to the smoking articles), the depression in the load applying cylindrical rods is determined, and then used to calculate the hardness from the above equation. The temperature is kept in the region of 22 degrees Centigrade ±2 degrees. The test described above is referred to as the DD60A Test. The DD60A Test and corresponding apparatus are described in more detail below in relation to FIGS. 5 to 7. The standard way to measure the filter hardness is when the smoking article is unsmoked.

Preferably, the hardness of the segment is at least about 75%, more preferably at least about 80%, and even more preferably at least about 85%. Preferably, the hardness of the segment is less than about 100%, more preferably less than about 95%, and even more preferably less than about 94%. This can provide a mouthpiece with a satisfactory firmness for the consumer.

The desired firmness properties that the one or more wrappers help the mouthpiece to have may be quantified in terms of an ovality value. The term "ovality" used throughout this specification denotes the degree of deviation from a perfect circle. Ovality is generally expressed as a percentage. FIG. 2 shows a perfect circle. In FIG. 2, dimension a=dimension b, since both dimensions are equal to the diameter of the circle. FIG. 3 shows an oval. In FIG. 3, dimension a≠dimension b. Referring to FIGS. 2 and 3, ovality is given by:

$$\text{ovality}(\%) = \frac{2(a-b)}{a+b} * 100\%$$

where a is the largest external diameter of the oval or circle and b is the smallest external diameter of the oval or circle. In the case of an oval or ellipse, a is the major axis of the ellipse, and b is the minor axis of the ellipse. Since a=b in a perfect circle, the ovality of a perfect circle is equal to 0%.

To determine the ovality of a portion (such as a filter) of a smoking article in accordance with the present invention, the mouth end is viewed along the longitudinal direction of the smoking article. For example, the smoking article may be positioned on the mouth end on a transparent stage, so that an image of the mouth end of the smoking article is recorded by a suitable imaging device located below the stage.

To simulate the smoking of a smoking article, the smoking article is subjected to a standard smoking test under ISO conditions (35 ml puffs lasting 2 seconds each, with puffs occurring once every 60 seconds) as set out in ISO 4387: 2000. In the ISO test method, the smoking article is smoked with the ventilation zone fully uncovered. Where it is necessary to measure the ovality after deformation tests performed both before and after smoking, two samples of smoking articles having the same design should be used. That is, non-deformed unsmoked smoking articles should be used for the pre-smoking deformation tests, and non-deformed smoking articles having the same design are subjected to the smoking test and used for the post-smoking deformation tests.

It is preferable that the mouth end has a low ovality after deformation. Thus, preferably, the ovality of the furthest downstream end of the smoking article, after a 50% deformation of the furthest downstream end of the smoking article, is less than about 25%.

Moreover, it is preferable that the mouth end return to as close to circular as possible after deformation, even after smoking. Thus, preferably, the ovality of the furthest downstream end of the smoking article, after a 50% deformation of the furthest downstream end of the smoking article, performed after the smoking article has been subjected to a smoking test (as described above), is less than about 25%.

Preferably the one or more wrappers have a combined thickness of between about 100 μm and about 210 μm, more preferably between about 120 μm and about 180 μm. In some preferred embodiments, the one or more wrappers comprise a first wrapper having a thickness of between about 90 μm and about 120 μm, preferably about 100 μm. Alternatively or additionally, preferably the one or more wrappers comprise a second wrapper having a thickness of between about 30 μm and about 70 μm, preferably about 40 μm. Preferably, the first wrapper is adjacent to the segment comprising polylactic acid, and preferably the first wrapper extends along the entire length of the mouthpiece. Preferably, the second wrapper circumscribes the first wrapper and connects the mouthpiece to the aerosol generating substrate.

The one or more wrappers may comprise any suitable material or combination of materials. Examples of suitable materials include, but are not limited to, cellulose based materials, paper, cardboard, recon, cellulose based film, and combinations thereof. The one or more wrappers may be printed, embossed, debossed or otherwise embellished with manufacturer or brand logos, trade marks, slogans and other consumer information and indicia. Preferably, the one or more wrappers comprise paper.

Any suitable arrangement of wrappers may be provided. For example, the mouthpiece may comprise multiple segments each with their own wrapper, and a combining wrapper circumscribing the multiple segments. Alternatively or additionally, the one or more wrappers may include a tipping paper circumscribing the segment and the mouthpiece, and connecting the mouthpiece to the aerosol generating substrate. In preferred embodiments, the one or more wrappers is a single wrapper which circumscribes the entire length of the mouthpiece, and a tipping paper further circumscribes the single wrapper to connect the mouthpiece to the aerosol generating substrate. In such embodiments, the single wrapper preferably has the basis weight and thickness features described above in respect of the one or more wrappers.

Preferably, the one or more filter wrappers have low porosity. Preferably, the one or more filter wrappers have a porosity of less than about 1000 Coresta units, more preferably less than about 500 Coresta units, and even more preferably less than about 100 Coresta units. The porosity may be as low as 100 Coresta units or lower, or 20 Coresta units or lower. In addition, or in the alternative, the porosity may be more than about 1 Coresta unit.

The mouthpiece may have any suitable construction. In some preferred embodiments, the only filter segment in the mouthpiece is the segment comprising polylactic acid. Therefore, preferably, no additional segments are provided either upstream or downstream of the segment comprising polylactic acid. Alternatively, in some other preferred embodiments, the mouthpiece comprises one or more additional segments upstream or downstream of the segment comprising polylactic acid. Thus, exemplary mouthpiece structures that may be used include, but are not limited to, a mono filter, a dual filter, a triple filter, a single or multi cavity filter, and combinations thereof.

If the mouthpiece comprises a multi component mouthpiece comprising a plurality of segments, the one or more wrappers may surround one, some or all of the segments. Preferably, each segment comprises a respective wrapper and the whole filter is surrounded by a further wrapper, combining the segments together.

Mouthpieces according to the disclosure can be attached to a tobacco rod to form all or at least part of a smoking article. Preferably, the mouthpiece is axially aligned with the tobacco rod. In many embodiments, the mouthpiece is joined to the tobacco rod with tipping paper.

In some embodiments, the smoking article is a conventional cigarette in which the aerosol generating substrate is provided in the form of a cylindrical tobacco rod, and in which the mouthpiece includes a filter. Alternatively, the smoking article may be one in which an aerosol forming substrate, such as tobacco, is heated rather than combusted, or one in which a nicotine-containing aerosol is generated from a tobacco material, tobacco extract, or other nicotine source, without combustion, and in some cases without heating, for example through a chemical reaction.

The term "phenols" refers to a class of chemical compounds consisting of a hydroxyl group (—OH) bonded directly to an aromatic hydrocarbon group. The phenol group includes phenol, catechol, m+P cresols, and o-cresol.

The term "additive for reducing phenols" refers to any additive, which when added to a mouthpiece for a smoking article, is capable of reducing the level of at least one of phenol, catechol, m+P cresols, and o-cresol in the smoke, when subjected to standard smoking test.

The terms "upstream" and "downstream" refer to relative positions of elements of the smoking article or filter described in relation to the direction of mainstream smoke as it is drawn from the aerosol generating substrate and through the filter or mouthpiece.

Features and advantages described in relation to one aspect of the invention may also be applicable to another aspect of the invention.

The invention will be further described, by way of example only, with reference to the accompanying drawings in which.

Figure 1:
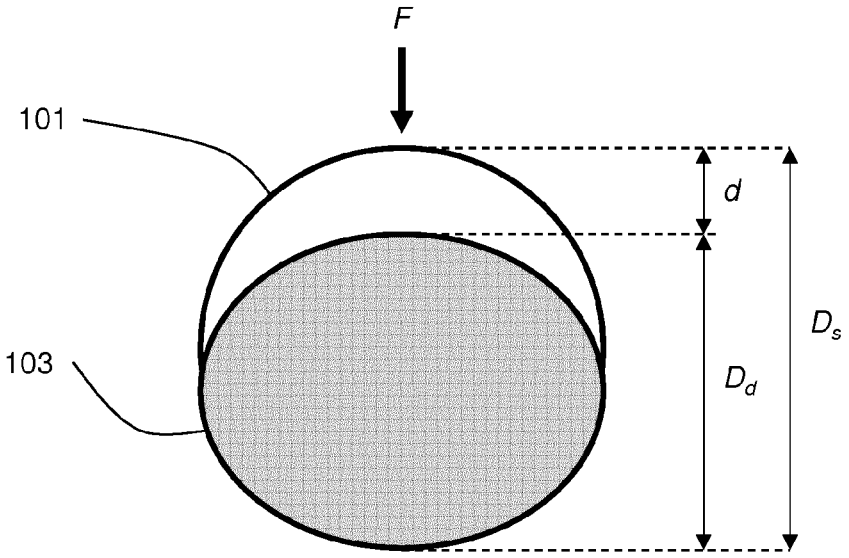
FIG. 1 illustrates the definition of hardness.
Figure 2:
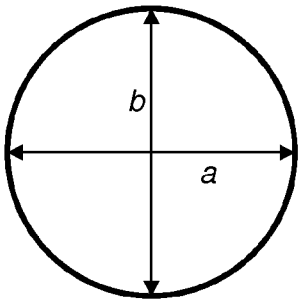
FIG. 2 illustrates the definition of ovality, using a perfect circle.
Figure 3:
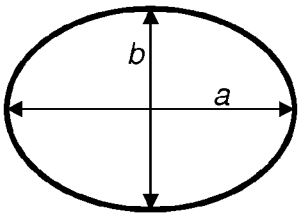
FIG. 3 illustrates the definition of ovality, using an oval.
Figure 4:
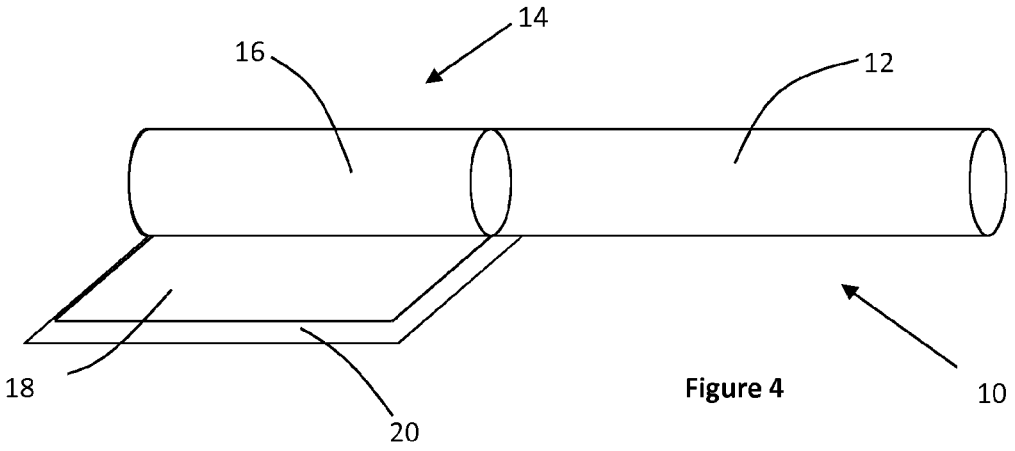
FIG. 4 shows an unwrapped smoking article in accordance with a first embodiment of the present invention.

The filter cigarette 10 shown in FIG. 4 comprises a wrapped rod 12 of tobacco cut filler which is attached at one end to an axially aligned filter 14 in accordance with the present invention. The filter 14 comprises a single segment 16 of filtration material, the filtration material comprising fibres formed from a blend of about 85% by weight polylactic acid, 10% by weight polyglicolic acid, and 5% by weight poly-(L)-lactic acid. The segment 16 also comprises an additive for reducing phenols in the smoke produced by the tobacco rod 12. The segment of filtration material 16 is circumscribed by a plug wrap 18, having a basis weight of about 78 grams per square metre. The wrapped tobacco rod 12 and the filter 14 are joined by a band 20 of tipping paper, which circumscribes the entire length of the filter 14 and an adjacent portion of the wrapped tobacco rod 12.

Six different sample filters were constructed with the filtration materials shown in Tables 1 and 2 below. The filters were attached to tobacco rods to form smoking articles and the smoking articles were subjected to a standard smoking test under ISO conditions (35 ml puffs lasting 2 seconds each, with puffs occurring once every 60 seconds) as set out in ISO 4387:2000. In the ISO test method, the smoking article is smoked with the ventilation zone fully uncovered. The delivery levels of certain phenols for each smoking article were measured. Tables 1 and 2 show the delivery levels of these smoke constituents per milligram of nicotine delivery, for each of the six different sample smoking articles.

TABLE 1

| Smoke constituent normalized to milligram (mg) of nicotine | Reference Cellulose Acetate Fibres + 7% Triacetin | Polylactic Acid (PLA) Fibres + No additive | PLA Fibres + 10% Triacetin | PLA Fibres + 10% Mixture (of 96-98% triacetin + 2-4% cellulose acetate flakes) |
|---|---|---|---|---|
| Phenol (μg) | 10.87 | 27.20 | 14.92 | 11.82 |
| m cresols (μg) | 2.43 | 4.53 | 2.94 | 2.54 |
| p cresols (μg) | 6.04 | 11.68 | 7.32 | 6.44 |
| o-cresol (μg) | 2.87 | 6.25 | 3.35 | 2.64 |

TABLE 2

| Smoke constituent normalized to milligram (mg) of nicotine | Reference Cellulose Acetate Fibres + 7% Triacetin | Polylactic Acid (PLA) Fibres + No additive | PLA Fibres + 10% PEG400 | PLA Fibres + 10% Triethyl Citrate |
|---|---|---|---|---|
| Phenol (μg) | 10.87 | 27.20 | 10.28 | 6.90 |
| m cresols (μg) | 2.43 | 4.53 | 2.48 | 1.72 |
| p cresols (μg) | 6.04 | 11.68 | 6.29 | 4.36 |
| o-cresol (μg) | 2.87 | 6.25 | 2.67 | 1.49 |

As can be seen from Tables 1 and 2, the filter having polylactic acid (PLA) fibres with no additive delivered a noticeably higher amount of phenols than the reference standard cellulose acetate filter. However, the filters having polylactic acid with an additive delivered a comparable or lower amount of phenols than the reference standard cellulose acetate filter.

Figure 5:
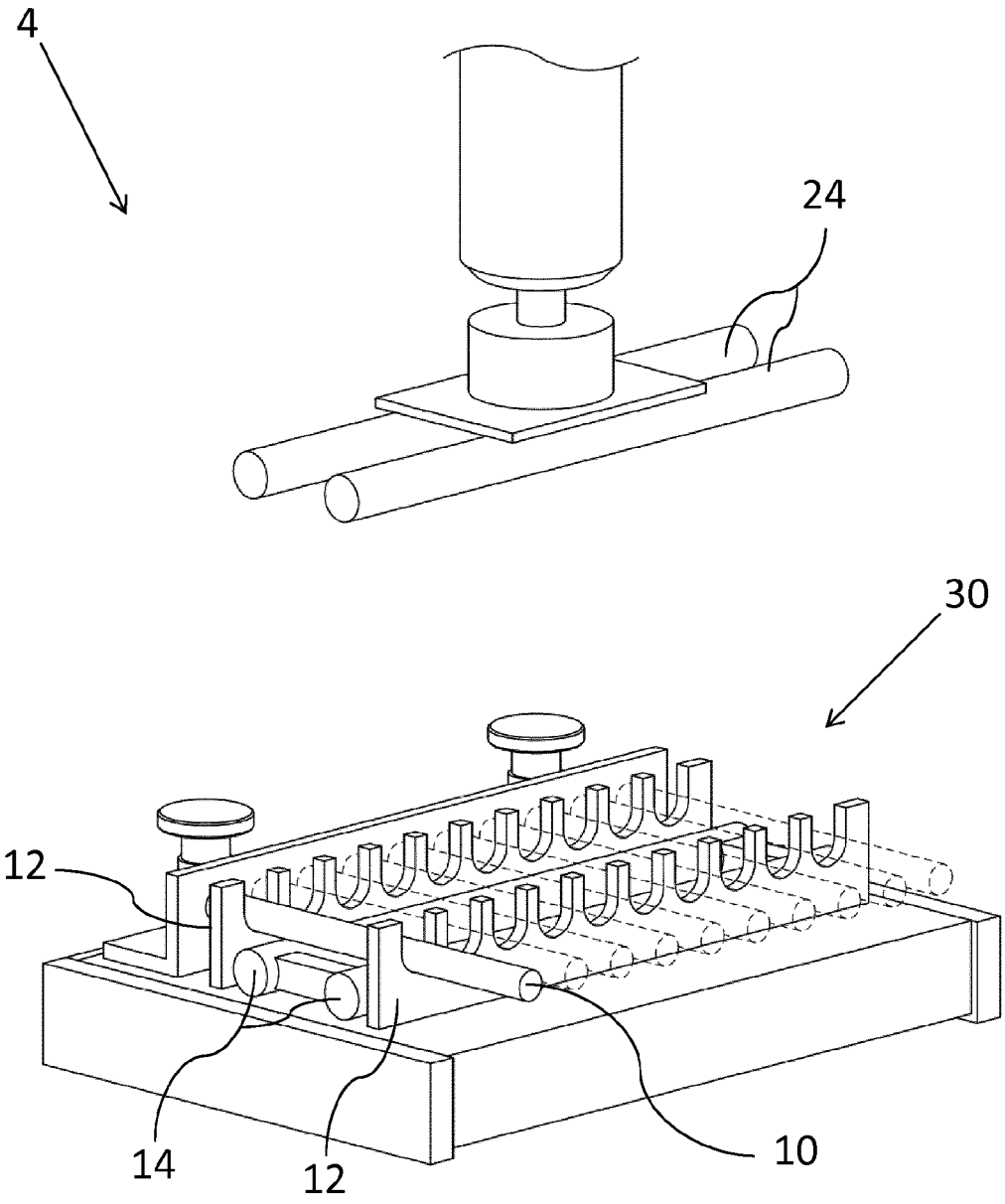
FIG. 5 illustrates a perspective view of an apparatus for determining the hardness of a filter or a smoking article, in a first configuration.
Figure 6:
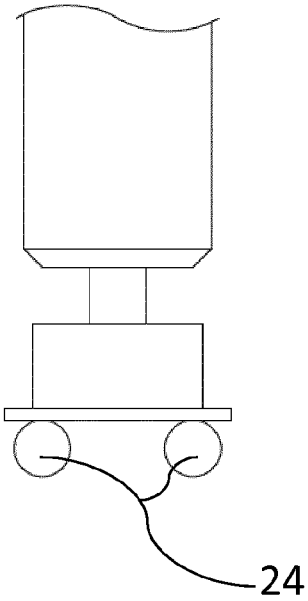
FIG. 6 illustrates a side view of the apparatus of FIG. 5, in a first configuration.
Figure 6:
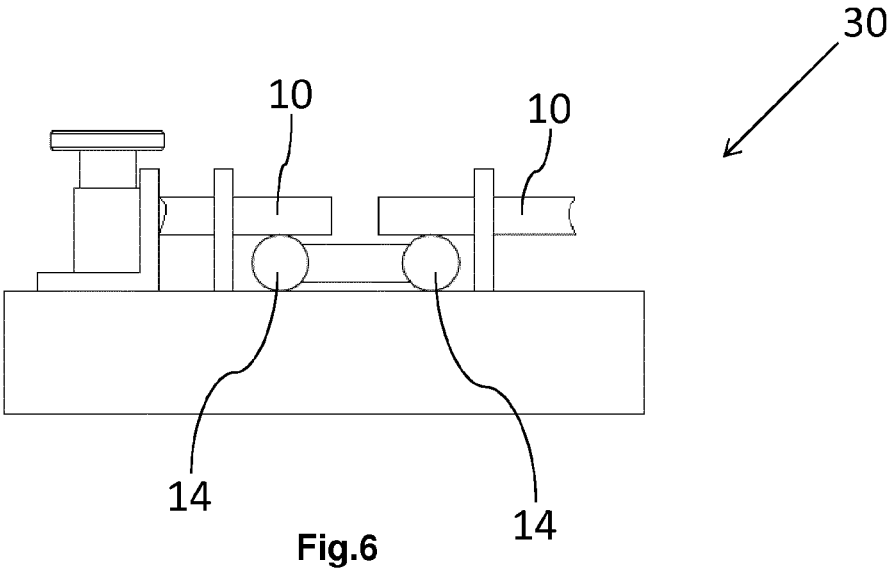
Figure 7:
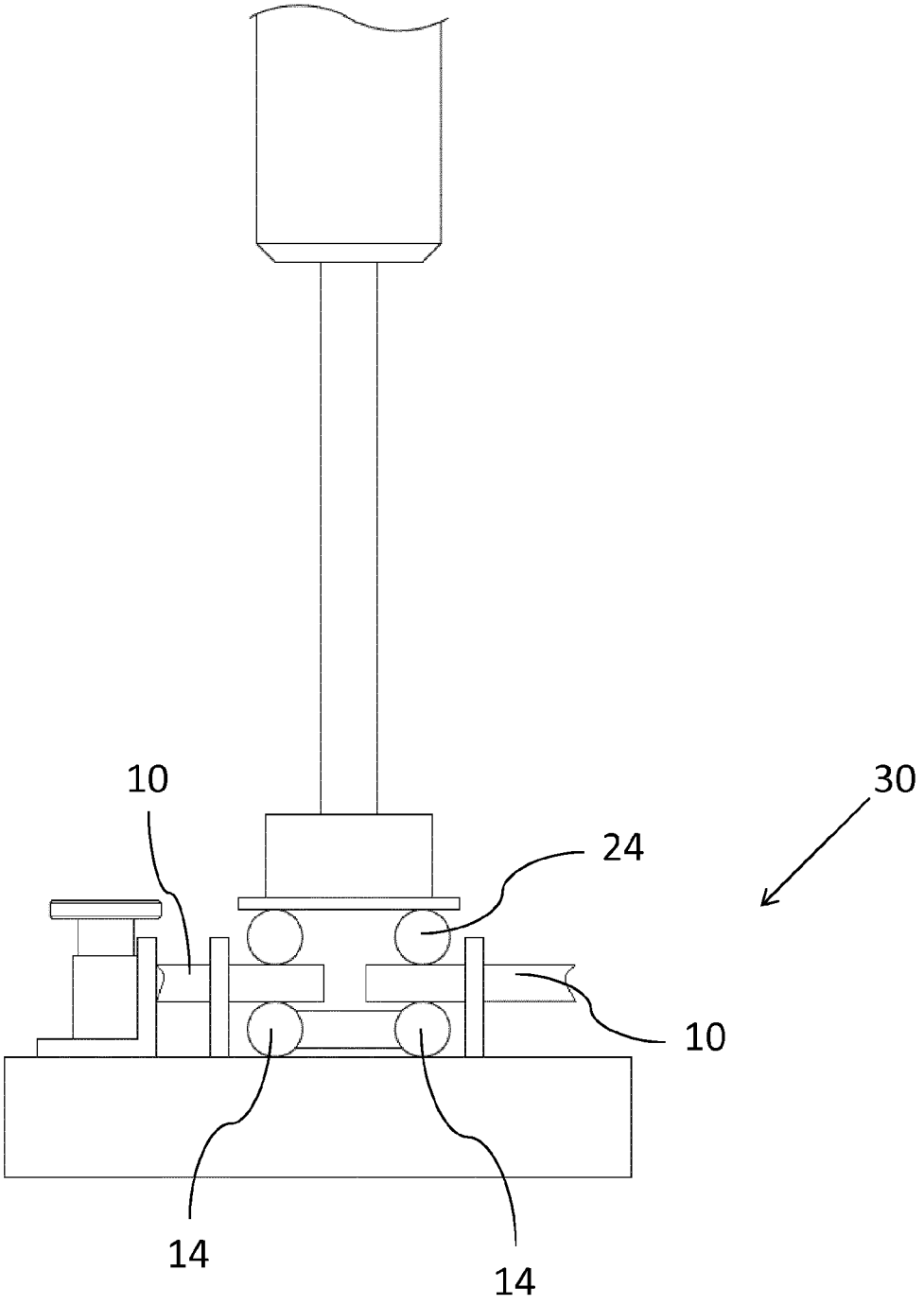
FIG. 7 illustrates a side view of the apparatus of FIG. 5, in a second configuration.

FIGS. 5, 6 and 7 depict an apparatus for testing the hardness of smoking articles filters.

The apparatus may be a known DD60A Densimeter (manufactured and made commercially available by Heinr. Borgwaldt GmbH, Germany) device, which is fitted with a measuring head for cigarettes and with a cigarette receptacle. As described in more detail below, the hardness of samples can be tested by following the method which is recommended for the known DD60A Densimeter device (manufactured and made commercially available by Heinr. Borgwaldt GmbH, Germany). That is, a sample of smoking articles is held in parallel alignment, and subjected to an overall load of 2 kg, for a period of 20 seconds, and the diameters of the smoking articles before and after compression are recorded. The depression is used to determine the hardness (%) of each smoking article.

FIG. 5 is a perspective view of an apparatus 4, such as a DD60A Densimeter device, for determining the hardness of a filter of a smoking article. The apparatus includes two parallel load applying rods 24 positioned over a support plate 30. The support plate 30 includes two parallel, spaced apart walls 12, with each wall 12 having ten equally spaced recesses. The recesses are arranged to prevent the smoking articles 10 from contacting one another during testing.

As can be seen in FIG. 5, ten identically designed smoking articles 10 are aligned parallel in a plane, and placed on underlying cylindrical rods 14. The smoking articles 10 extend between corresponding recesses in the walls 12 to hold the smoking articles in place. The underlying cylindrical rods 14 extend parallel to the walls 12. Each smoking article 10 contacts the underlying rods 14 at two points, making for twenty total points of contact between the smoking articles to be tested and the underlying rods 14.

To test the hardness of a smoking article's filter, the smoking articles should be positioned such that the portion of the filter to be tested is in contact with the underlying rods 14. If filter is too short and the portion of the filter to be tested either does not contact both rods or contacts the rods very close to the ends of the portion of the filter to be tested, then it would be appreciated that this could be achieved by using twenty cigarettes in a back-to-back configuration, such as that shown in FIG. 6.

As shown, the concept of the DD60A Test is that the underlying cylindrical rods contact the sample material to be tested at twenty contact points. If the filter is sufficiently long to extend across the underlying rods, then the twenty contact points can be provided with ten samples (as shown in FIG. 5). If the filter is not sufficiently long, then the twenty contact points can be provided with twenty samples, as shown in FIG. 6.

As can be seen in FIG. 6, portions of the tobacco rods have been removed from each smoking article 10, and the filter portion of each smoking article 10 rests on a respective cylindrical rod 14. In FIG. 6, the hardness of the mouth end segment is being tested, and therefore it is this portion of the filter which rests on the rod 14, and the mouth end segment is approximately centered on the rods 14. If necessary, the tips of the smoking articles extending away from the cylindrical rods 14 may be supported by an underlying supporting means to prevent pivoting of the smoking articles.

The apparatus is shown in FIG. 6 in a first configuration, in which the two load applying cylindrical rods 24 are raised above and out of contact from the smoking articles 10. To test the hardness of the smoking articles, the load applying cylindrical rods 24 are lowered to a second configuration, to come into contact with the smoking articles 10, as shown in FIG. 7. When in contact with the smoking articles 10, the load applying rods 24 impart an overall load of 2 kg across the twenty contact points of the smoking articles 10 for a duration of 20 seconds. After 20 seconds have elapsed (and with the load still being applied to the smoking articles), the depression in the load applying cylindrical rods 24 across the smoking articles is determined, and then used to calculate the hardness.

The invention claimed is:

1. A smoking article comprising:

an aerosol generating substrate; and a mouthpiece attached to the aerosol generating substrate, the mouthpiece comprising a segment comprising:

a filtration material comprising polylactic acid; and an additive for reducing phenols;

wherein the additive comprises a mixture of triacetin with cellulose acetate flakes.

2. A smoking article according to claim 1 wherein the filtration material comprises a plurality of fibres formed at least in part of polylactic acid.

3. A smoking article according to claim 2, wherein the fibres are substantially unconnected to one another.

4. A smoking article according to claim 3, wherein the filtration material comprises a blend of the polylactic acid and at least one other polymer.

5. A smoking article according to claim 1, wherein the filtration material comprises a blend of the polylactic acid and at least one other polymer.

6. A smoking article according to claim 5, wherein the blend comprises a blend of the polylactic acid, polyglycolic acid and poly-(L)-lactic acid.

7. A smoking article according to claim 1, wherein the additive for reducing phenols is dispersed amongst the filtration material.

8. A smoking article according to claim 7, wherein the additive for reducing phenols is the only additive provided in the segment.

9. A smoking article according to claim 1, wherein the additive for reducing phenols is the only additive provided in the segment.

10. A smoking article according to claim 1, wherein the mouthpiece further comprises one or more wrappers circumscribing the segment, and wherein the one or more wrappers have consists of a single wrapper having a base weight of at least 50 grams per square metre ($gm^{-2}$), or wherein the one or more wrappers consists of a plurality of wrappers, the plurality of wrappers having a combined basis weight of at least 50 grams per square metre ($gm^{-2}$).

11. A smoking article according to claim 10, wherein the one or more wrappers comprise a first wrapper, the first wrapper being in direct abutment with the filtration material and having a basis weight of at least 50 grams per square metre ($gm^{-2}$).

12. A smoking article according to claim 10, wherein the one or more wrappers consists of a single wrapper having a thickness of at least about 80 μm, or wherein the one or more wrappers consists of a plurality of wrappers, the plurality of wrappers having a combined thickness of at least 80 μm.

13. A smoking article according to claim 10, wherein the one or more wrappers consists of a single wrapper having a bending stiffness of at least 0.08 N in a machine direction of the wrapper, or wherein the one or more wrappers consists of a plurality of wrappers, the plurality of wrappers having a combined bending stiffness of at least 0.08 N in the machine direction of the plurality of wrappers.

14. A smoking article according to claim 1, wherein the segment has a hardness of at least about 75%.

15. A smoking article according to claim 1, wherein the segment has an ovality, after a 50% deformation of the segment, of less than about 25%.

16. A smoking article according to claim 1, wherein the filtration material comprises a gathered sheet of material comprising the polylactic acid.

* * * * *